US007438108B2

(12) United States Patent
Hänsch

(10) Patent No.: US 7,438,108 B2
(45) Date of Patent: Oct. 21, 2008

(54) SEPARATING AND TRANSPORTING FLEXIBLE TWO-DIMENSIONAL (SHEET-LIKE) PRODUCTS

(75) Inventor: Egon Hänsch, Wetzikon (CH)

(73) Assignee: Ferag AG, Hinwil (CH)

( * ) Notice: Subject to any disclaimer, the term of this patent is extended or adjusted under 35 U.S.C. 154(b) by 382 days.

(21) Appl. No.: 11/038,494

(22) Filed: Jan. 21, 2005

(65) Prior Publication Data

US 2005/0189696 A1 Sep. 1, 2005

(30) Foreign Application Priority Data

Jan. 21, 2004 (CH) ..... 0074/04

(51) Int. Cl.
*B65C 9/00* (2006.01)

(52) U.S. Cl. ..... 156/568; 156/571; 271/276

(58) Field of Classification Search ..... 271/275, 271/276, 99, 100, 101, 102, 104, 106; 156/568, 156/571, 364
See application file for complete search history.

(56) References Cited

U.S. PATENT DOCUMENTS 3,572,691 A 3/1971 Heinricy
4,021,293 A * 5/1977 Total ..... 156/568
4,293,365 A 10/1981 Geyser et al.
4,619,726 A * 10/1986 Cook et al. ..... 156/366
4,981,235 A 1/1991 Ferrini et al.

FOREIGN PATENT DOCUMENTS

| | | |
|---|---|---|
| CH | 684589 | 10/1994 |
| DE | 28 43 418 | 4/1979 |
| EP | 1 086 914 | 3/2001 |
| EP | 0 988 246 | 4/2002 |
| EP | 0 897 871 | 11/2002 |
| WO | WO/9639331 | 12/1996 |

* cited by examiner

*Primary Examiner*—Kaitlin S Joerger
(74) *Attorney, Agent, or Firm*—Robert E. Bushnell, Esq.

(57) ABSTRACT

In a method and apparatus to separate and transport flexible two-dimensional products, such as paper sheets having an adhesive, the products are supplied via a product supply stack to a separation device. The separation device includes at least one conveyor element. The products at the same time are only stabilized on an edge or a portion thereof and are free at the other portions thereof. The at least one conveyor element separates the products and convey these subsequently to a transfer location. The at least one conveyor element is multi-functional and has a flattened geometry. The at least one conveyor element is moved in a direction of movement essentially parallel to a plane of the product supply stack. The direction of movement moves from one free end of the products to a stabilized region of the products. At the same time, the at least one conveyor element moves below the frontmost product of the supply stack and subsequently seizes the frontmost product at its distant side and further conveys it.

15 Claims, 6 Drawing Sheets

SEPARATING AND TRANSPORTING FLEXIBLE TWO-DIMENSIONAL (SHEET-LIKE) PRODUCTS

CLAIM OF PRIORITY

This application makes reference to, incorporates the same herein, and claims all benefits accruing under 35 U.S.C. §119 from an application entitled A METHOD AND A DEVICE FOR SEPARATING AND FOR THE CONTINUED TRANSPORT OF FLEXIBLE, TWO-DIMENSIONAL PRODUCTS filed with the Swiss Federal Institute of Intellectual Property on 21 Jan. 2005, and there duly assigned Serial No. 2004-0074.

BACKGROUND OF THE INVENTION

1. Field of the Invention

The present invention relates to a method and to an apparatus for separating and transporting flexible two-dimensional (sheet-like) products.

2. Description of the Related Art

Various methods and devices for separating labels and individual sheets and for their subsequent further transport are known from the state of the art, amongst other things under the description feeding devices. Such feeding devices for individual sheets, as a rule, are designed such that they pull off an individual product from a stack of sheets with suction elements and/or grippers, and then convey these individual products to a transfer location where a further working step can be carried out. Such feeding devices, as a rule, are optimized for the processing of a specific product and can not be applied to other products or within any context of the machine without modification.

The present invention in particular is envisaged for separating adhesive-coated labels which can be released from one another and for transporting them and for solving those technical particularities and difficulties which these products entail. Since 1980, self-sticking, re-releasable labels or pieces of paper ("self-adhesive notes" or paper sheets having an adhesive backing) have been on the market and have been used for various purposes, amongst others under the trademark description POST-IT®.

WO 96/39331 relates to an apparatus for attaching self-adhesive labels from a label dispenser, in which labels are transferred from a dispenser roller onto moving products by a drum provided with a radially projecting transfer element. The take-over and dispensing of the labels is effected by controlling vacuum grippers provided at the peripheral ends of the transfer element. The individually seized labels are transported tangentially away from the respective dispenser tape. A precise, reliable and gentle separation of stacked labels is not specified.

EP 0 988 246 relates to a stack holder for accommodating self-adhesive, re-peelable product supplements. Separators (plate-like slides, blow nozzles) are provided on the lower side of the stack holder to peel away individual product supplements. The adhesive-free part of a product supplement is moved perpendicularly away from the following product supplement, and the product supplement is subsequently separated by a rotating drum and is pulled off parallel to the plane of the sheet and essentially tangentially, as in the case of WO 96/39331. In contrast to WO 96/39331, the labels here are held during the conveying by clamping grippers instead of vacuum grippers.

A further feeding device is referred to in CH 684 589 which permits supplements to be deposited onto printed sheets by an adhesive. In contrast to the two above-mentioned references, the supplements (or printed sheets), during their conveying, are provided with adhesive only after their separation. A rotating conveyor drum with several planetarily driven catch drums mounted on the periphery of the conveyor drum is provided. Again, the peeling-away of the sheets is effected parallel to their side surfaces with respect to the catch drum, that is, a tangential removal of the printed sheets from the stack. This device, due to the addition of an adhesive during transport as well as the required size of the catch drum which must be matched to the product size demands a large overall design. Furthermore, the addition of an adhesive during transport is quite complicated with regard to technology and demands cycle time and leads to additional maintenance expenses.

A further solution for supply labels is referred to in EP 0 897 871. Here, labels are transferred from a punched tape sheet. The labels must be separated long before their take-over by rotating vacuum grippers and must be provided with an adhesive during the rotation movement so that they can be deposited onto corresponding products. Two other devices which although being different with regard to design, correspond to this label transfer principle are further referred to in German published application DE 28 43 418 and U.S. Pat. No. 4,293,365. These devices however in each case take the labels from a stack. With both devices, in each case, the labels taken from the label stack by rotating label carriers are transported past an adhesive depositing device and then deposited onto the associated product.

The devices discussed above each have one or more of the following disadvantages: inasmuch as the deposition of the adhesive is not effected until the transport path from the label dispenser to the dispensing location, one must accept disadvantages with regard to the cycle time, additional maintenance expenses and larger construction sizes. The separation and the taking of the products to be transferred, specifically labels, has only been solved for products free of adhesive, wherein here one must accept the limitations of the stack holder (the taking only being possible on the upper side of the stack, a limitation of the stack height, complicated control or separation elements). Inasmuch as adhesive-coated labels or products are to be separated, one must anticipate particular qualities with regard to the dispenser medium (dispenser rollers and likewise), or the taking of the product from the stacks is unreliable or possible only with restrictions.

Specifically, with EP 0 988 246, a separation by the separation element can no longer be ensured in a reliable manner when it comes to large stacks, and the forces which are required for the further transport are greatly dependent on the contact pressure on the lowermost product supplement. Depending on the applied adhesive, its properties as a result of the shear movement on removal of a product supplement can lead to a compromising of the product (smudging, formation of creases, deposits) or a disadvantageous impairment of the adhesive location itself (in particular, a shearing-away or regional release of the adhesive). Accordingly, complicated regulating and control elements, and where necessary additional sensor devices, are required. With adhesive regions having a larger area, the separation is no longer possible at all or is only possible with very small intermediate stacks having a limited contact pressure.

An apparatus for the transport of printed products is referred to in EP 1 086 914 of the assignee of the present application, which separates such products from a stack with support elements and holding members which rotate about an axis and which are supported by a separating member, thereby separating a printed product from a stack lying below the support elements and transporting it to a dispensing location. In contrast to the above-mentioned references, this solution has a fundamentally different separating principle which is significantly more reliable and can also separate adhesive-coated printed products in a quick and accurate manner without any drawbacks. This device, however, is subject to a disadvantage inasmuch as the supply of the stack is effected from below, and an additional expense with regard to control technology and design arises if the separating and conveyor element are not designed as separate elements or the supply of the stack is to be arranged at another location.

SUMMARY OF THE INVENTION

An object of the present invention is to provide a method and an apparatus which permits a reliable separation of flexible two-dimensional (sheet-like) products, in particular, products which are coated with an adhesive, and their continued transport, wherein an infinite spatial arrangement of the stack element and a reliable separation is possible with a low design, maintenance and control expense.

The invention proceeds from the inventive concept that the separation, removal and transport (per product) is effected by a single element, wherein the product stack is stabilized by a static or quasi-static element at a single location or at a single edge of the products—all further edges/regions of the products are completely free or are supported and stabilized exclusively by dynamically changing elements, appropriately exploiting the inertia of the products. According to the present invention, this concept is combined with the advantageous principle of the removal of a product being effected in a manner such that the direction of removal or the peeling-away of the product is not effected in the direction of from the fixed, stabilized or adhesive-coated region (hereinafter "stabilized region") to the free region as is chiefly the case with the state of the art, but in an essentially opposite direction, i.e. in the direction from the free region to the stabilized region. Furthermore, with the present invention, one accomplishes the separation in a targeted manner by a single element, in that this carries out the separation and removal as well as the complete conveying process up to the transfer location by pushing-back and subsequently seizing the initially distant side of the product.

The method according to the invention is preferably suitable for separating and transporting paper sheets or pieces of paper having an adhesive. At the same time the products are supplied to a separation device with a product supply stack. This comprises at least one conveyor element which separates the product stabilized only on a portion thereof and conveys it to the transfer location. The conveyor element in the active region is moved in a movement direction which is essentially parallel to the plane of the stack. This runs from a free region of the products to a stabilized region of the products, wherein the conveyor element runs below the frontmost product of the supply stack and subsequently seizes this product on its distant side. At the same time, the products are moved or pushed back in essentially the same movement direction, wherein the portion thereof of the frontmost product at its stabilized edge experiences a force perpendicular to the plane of the stack. Only in the last phase of the separation do the products undergo a movement component in their longitudinal direction, and by this movement, they are released from the stack. Various side surfaces of the conveyor element come into functional interaction with the initially distant side of the product during the pushing-back, until the seizing of the product.

The running of the conveyor element beneath the products is preferably initiated with an initiation element which runs in the same direction as the conveyor element, wherein this initiation element is arranged in front of the conveyor element in the movement direction. In order to stabilize the free edges of the products, these are preferably dynamically supported by an initiation element and a conveyor element in an alternating manner.

An auxiliary element is preferably applied in the last phase of the separation, which can contain moving parts, and supports the conveyor element on overcoming the release force with the definitive separation of the frontmost product from the stack.

A take-over device can preferably be arranged downstream of the separation device, the take-over device turning the separated products (where appropriate about more than one axis) and dispensing these to envisaged products or further conveyor regions.

The control of the gripping and the release of the products by the separation and conveyor element are preferably effected by a pneumatic system, wherein at a certain point in time air exits at certain openings of the conveyor element and simultaneously air can be suctioned at other openings of the same conveyor element. The pneumatic system can be designed such that air can be suctioned or expelled via the same openings in a manner which is controlled with respect to time.

According to the present invention, the conveyor element runs along and around an endless path, preferably a circular path, and has a flattened geometry which can have a kidney shape with an acute leading edge. The conveyor element moves in the direction of the stabilized edge of the product which, after the conveyor element has run beneath it, is subsequently flipped over so that the side of the product which at the beginning was distant to the conveyor element now bears on the conveyor element and can be seized by it for the purpose of further conveying.

The initiation element is preferably driven about an axis allocated to it, in a manner running counter to the rotational direction of the conveyor elements, and roll on the frontmost product in a manner such that the product is lifted and so that said initiation element they exert no disadvantageous pulling action on the products in their longitudinal direction. For this, the former preferably has circular-segment shaped geometry with a curved outer surface and suction or other retention element.

BRIEF DESCRIPTION OF THE DRAWINGS

Exemplary embodiments of the present invention are explained in more detail in conjunction with the attached drawings in which.

DETAILED DESCRIPTION OF THE INVENTION

Figure 1:
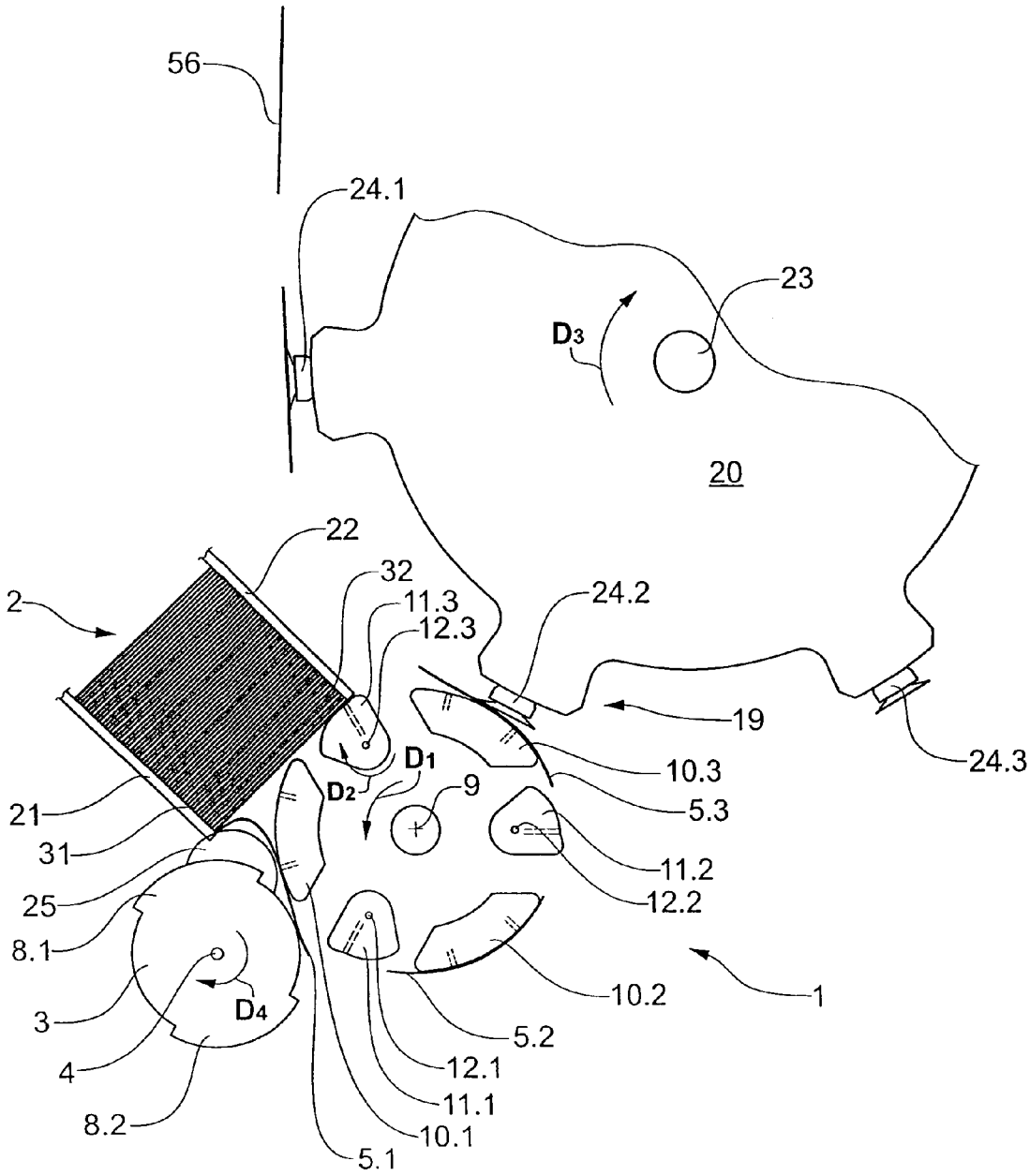
FIG. 1 is a schematic side view of an apparatus according to an embodiment of the present invention with a supply stack and a take-over device.

FIG. 1 is a side view of an apparatus according to an embodiment of the present invention for separating and transporting flexible two-dimensional products, with a product supply stack 2, a separator and conveyor 1 and take-over device 20 arranged downstream. The general term "products" used hereinafter is to be understood as any products which are flexible and two-dimensional, and have a certain material strength so that the flip-over and separating procedure explained in more detail below can be carried out and so that the products can be separated and transported by gripper bodies which, where appropriate, are smaller than the products themselves. Such products are preferably printed or blank individual sheets or order cards, with preferably at least one re-detachable adhesive connection. The present invention is also suitable for products such as flat sample bags or other product supplements.

Referring to FIG. 1, at least partly separated products 5.1 to 5.3 which are already being transported are supplied from the supply stack 2. The supply stack 2 is arranged above the separator and conveyor 1 (hereinafter called "a separator") and is inclined with respect to the vertical. The supply stack 2 has two guide surfaces, 21 and 22, which guide and support the stack of products. The stack 2 or its frontmost product 5.1 is stabilized or supported at one of its edges 31 by a stabilizer 25. It is to be noted that this stabilization can be effected by a static stabilizer, for example, an abutment or a projecting web, but also by a quasi-static stabilizer. A quasi-static stabilizer is to be understood as being a stabilizer which permanently supports the edge 31 of the frontmost product 5.1 and, for the purpose of reducing the friction, can contain moving parts. In FIG. 1, the quasi-static stabilizer 25 can be one or more rotating disks or a roller which permanently supports or stabilizes the edge 31 in the idle condition, as with a purely static stabilizer, but on removal of the frontmost product 5.1, moves the stabilizer 25 so that the frictional forces at the edge 31 are minimized. A reduction of the final removal force can alternatively be achieved with a controlled stabilizer, but this would require an additional expense with regard to machine technology.

It is important that the direction of rotation D1, in the embodiment shown here in the counterclockwise direction, is towards the stabilized edge 31. In other words, the separation device is not moved, as is usually the case with the prior art, such that a removal is effected essentially parallel to the surface of the product, away from the stabilizing edge 31 (tangential removal), but rather, the direction of rotation D1 is selected to be opposite to this so that the product is moved in a direction from the free edge 32 (see also FIG. 5) to the stabilized edge and thus is subjected to a turn-up or flip-over procedure described in more detail below. It is to be noted that this separation principle is specifically different from those principles with planetary, counter-running removal elements, such as, for example, with regard to the arrangement discussed in CH 684 589, or removal rollers running in a direction opposite to a main movement direction, such as, for example, with regard to the arrangement discussed in EP 0 988 246 (see FIG. 8 thereof). In those arrangements, the separation device, although being moved according to the direction of rotation D1, the relative movement to the products is stopped by counter-running elements, so that the removal elements effect a removal away from the stabilized edge in a conventional manner. A flip-over of the product to be separated over a short movement path amid the temporary deformation of the product, as is accomplished by the present invention, cannot be effected by the arrangements discussed in the two afore-cited references.

The separation device in accordance with an embodiment of the present invention comprises several rotating, multifunctional conveyor elements 10.1 to 10.3. These conveyor elements 10.1-10.3 have a common main rotation axis 9 about which they rotate in the counterclockwise direction (direction D1). Initiation elements 11.1 to 11.3 are arranged with these conveyor elements 11. These initiation elements 11.1-11.3, as the conveyor elements, have the same main direction of rotation D1 about the rotation (axis), but can additionally be rotated in the opposite direction about a secondary rotation axis 12.1 to 12.3 allocated to them. These secondary rotation axes 12.1-12.3 are equally distanced from the main rotation axis 9 and are moved on a common circular path. The contra-rotating direction of rotation D2 has the effect that the initiation element rolls smoothly essentially on the outer side of the frontmost product 5.1 and accordingly, no pulling force is exerted parallel to the side surface of the product to be lifted-away. In other words only a lifting of the free edge 32 of the product is effected by these elements, but no relative movement to the following product in the region of the stabilized edge 31.

At a transfer location 19, the products 5 are transferred to a take-over device 20 including a disk revolving about a rotation axis 23 in the clockwise direction in the direction of rotation D3, with radially projecting suction members 24.1 to 24.3. The suction members 24.1-24.3 preferably have a suction force which is larger in comparison to the conveyor elements 10.1-10.3 so that the transfer is possible in a simple manner. Alternatively, an active transfer by controlling the holding element on the conveyor elements 10.1-10.3 is possible. By suitably matching these elements in the region of the transfer location, a continuous release of the products from the conveyor elements 10.1-10.3 can be achieved.

An auxiliary element is arranged below the supply stack 2, and supports the removal of the products in the last phase. In this embodiment, the auxiliary element is a rotating body which revolves in the opposite direction to the direction of rotation of the conveyor elements, that is, in the direction of rotation D4 about an axis 4. The rotation body 3 comprises two peripheral pressing surfaces 8.1 and 8.2 which cooperate with one of the conveyor elements 10.1-10.3. By a clamping effect between this pressing surface 8.1 and 8.2 and one of the conveyor elements 10.1-10.3, the respective product 5 is correctly released from the stack. Specifically, with products which have an adhesive coating on the stabilized edge 31, this has the effect that the adhesive and frictional forces are overcome and the product is released in a precise and gentle manner.

The separation procedure and further transport is explained in more detail by the FIGS. 2*a* to 2*f*.

Figure 2A:
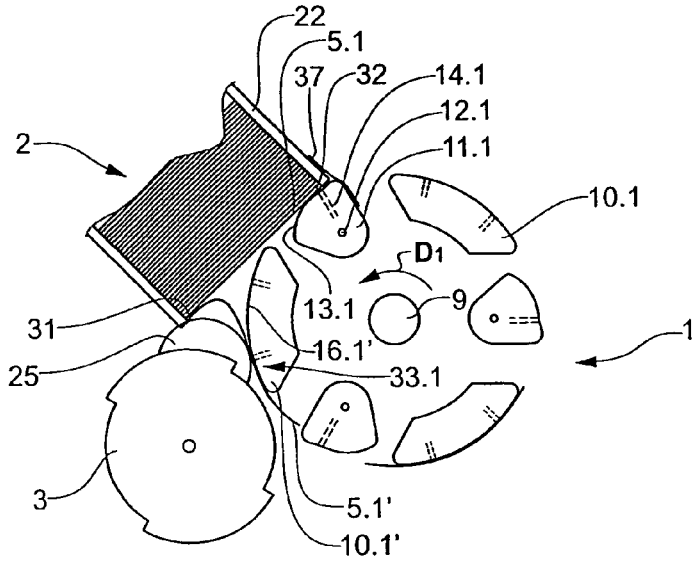
FIG. 2*a*-2*f* are views of sequences of the method according to an embodiment of the present invention and of the functions of the individual device elements.

As shown in FIG. 2*a*, a first initiation element 11.1 is located below the supply stack 2 and contacts the lowermost product 5.1 in the region of its free edge. The initiation element 11.1 has a support function for the stack 2 in this position, since the stack is otherwise supported exclusively at the lower lying edge 31 by a freely rotatable roller which forms the stabilizer 25. The free edge 32 of the lowermost product 5.1 is thus dynamically stabilized by the initiation element 11.1. The initiation element 11.1 (in the side view) has a geometry similar to a segment of a circle, wherein its surface, which is functionally important and which lies on the outside with respect to the main rotation axis 9, comprises an arch. This arch is designed such that this outer surface 13.1 rolls on the lower side of the product 5.1 as a result of the combination movement of the initiation element about the axes 12.1 and 9.

The description "a geometry similar to a segment of a circle" is not to be construed in a restrictive sense. Apart from typically rounded edges, modifications are possible as long as the movement path according to the present invention can be described and the mutual movement of the initiation element 11 and the conveyor element 10 according to the present invention is ensured (see, for example, FIGS. 2*c* and 2*d*).

A first conveyor element 10.1 is arranged to move after the initiation element 11.1 in the direction of rotation D1 and here is not yet in function. Otherwise the design corresponds to that of FIG. 1. The initiation element 11.1 has one or more suction bores or openings 14.1 which exit at the outer surface 13.1. The suction bore 14.1 is located on the periphery of the free edge 32 and by a suitable control has the effect that on account of a build-up of a vacuum in the suction bore 14.1, the free edge 32 is seized and held with a non-positive fit.

Figure 2B:
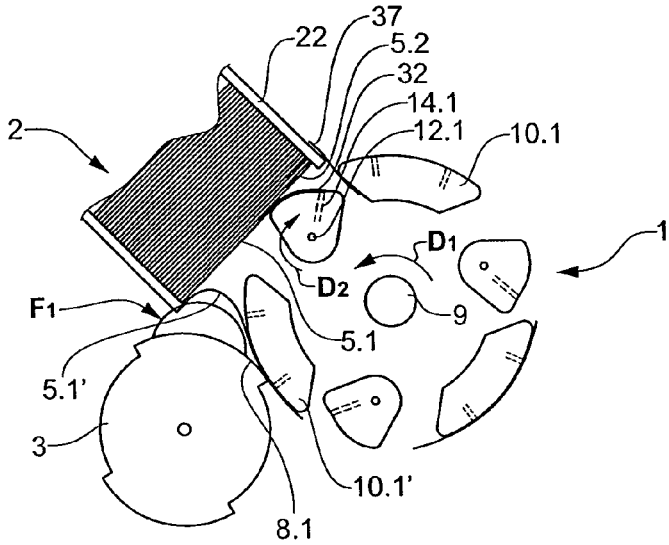

In the next moment which is shown in FIG. 2*b*, the separator has moved 20 in the direction of rotation D1. The initiation element 11.1 in the meanwhile has undergone a rotation in the clockwise direction about its axis 12.1 in the direction of rotation D2. The free edge 32 of the lowermost product 5.1, which is firmly held by the initiation element 11.1 was accordingly moved downwards from the stack and from now on is distanced from the free edge of the subsequent product 5.1. The conveyor element 10.1 continues to be without any functional effect. The initiation element 11.1 continues to support the stack 2 but from now on, as a result of its rolling on the lower side of the stack, is distanced somewhat further from the guide surface 22 which guides the free edges of the products of the stack 2.

Figure 2C:
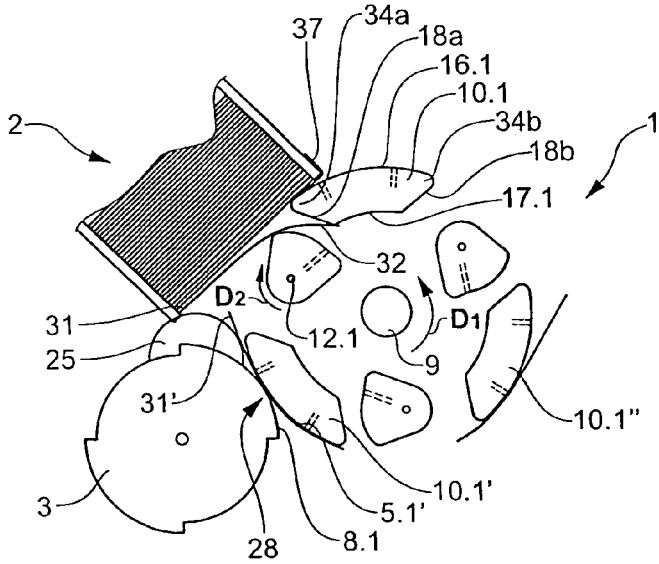

The subsequent FIG. 2*c* reveals that the separation device has rotated a further 20 in the rotational direction D1. The initiation element 11.1 has now rotated further about its rotation axis 12.1 in the direction of rotation D2 such that the product 5.1 has been moved downwards from the stack 2, and has already been released again from the initiation element at its free edge 32. The product 5.1 in this position essentially only continues to be supported at its edge 31. The initiation element 11.1, as a result of its circular-segment-like geometry, was moved from the stack 2 and no longer supports it. However, the conveyor element 10.1 continues to rotate in the direction of rotation D1 and supports the stack 2 from below at the free edges at its outer surface 16.1. In this manner, the dynamic support of the free edges 32 of the supplied products 5 is effected. At the same time, the initiation elements 11.1-11.3 and the conveyor elements 10.1-10.3 are arranged such that one of the initiation elements 11.1-11.3 or conveyor elements 10.1-10.3 to alternately dynamically stabilize the stack 2 at the free sides thereof. As a result of the inertia of the stack 2, it is possible for this dynamically alternating stabilization to undergo pauses for a short period of time or for both elements to take part in the stabilization for a short time during the change to the subsequent dynamic stabilization element.

The conveyor element (in the side view) has a flattened, kidney-shaped geometry. The corresponding longer side surface 16.1 at the same time is directed outwards with respect to the main rotation axis 9, and the shorter side surface 17.1 lies radially on the inside. According to the kidney shape, these two surfaces, specifically the functionally important outer surface 16.1, is curved. The outer surface here is defined by a uniform radius which corresponds to the shortest distance between the main rotation axis 9 and the lowermost product of the stack 2. Two surfaces 18*a* and 18*b* connect surfaces 16.1 and 17.1 and move at an acute angle with respect to a radial line from the rotation axis 9, so that the surfaces 18*a* and 18*b* converge with the outer surface 16 of the conveyor elements 10 at an acute angle, and have a wedge shape at their lateral ends 34*a* and 34*b*. This wedge shape permits the conveyor elements 10, as can be seen in FIG. 2*c*, to be introduced between the lifted lowermost product 5.1 and the rest of the stack 2. The lowermost product 5.1 is prevented from springing back towards the stack 2 by the surface 18*a* or the short surface 17.1, which is of particular significance when the products 5 have a high intrinsic stability and/or stick to one another over a large surface at the stabilized edge 31. The conveyor element thus according to the present invention comprises various functional surface or edges and ends. An acute angled end 34*a* moves beneath the product 5.1 to be separated. An extended surface 16.1 seizes the product, and a further surface 18*a*, together with the end 34*a*, push back and flip over the product 5.1.

Figure 2D:
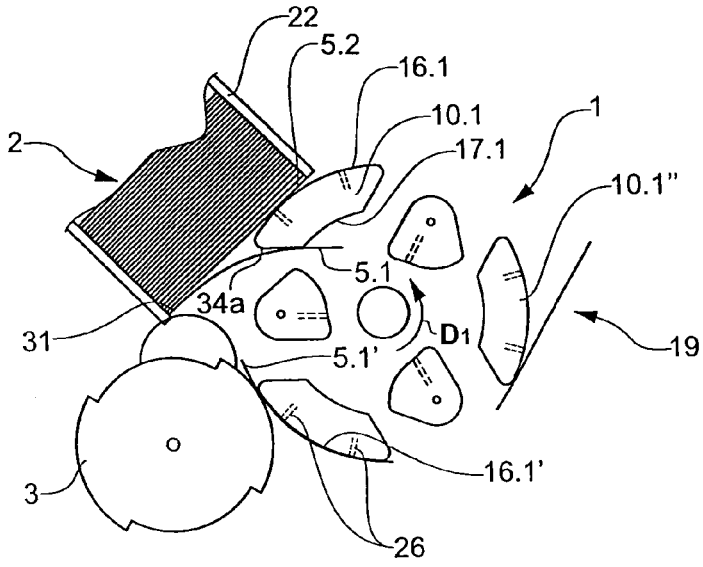
Figure 2E:
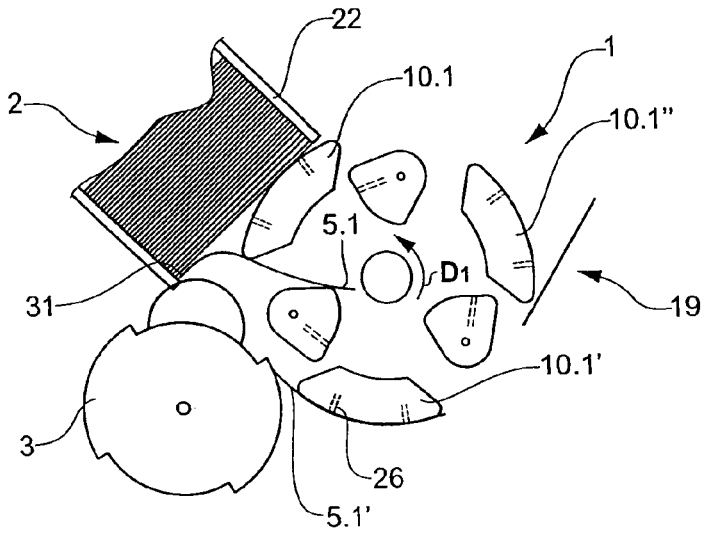
Figure 2F:
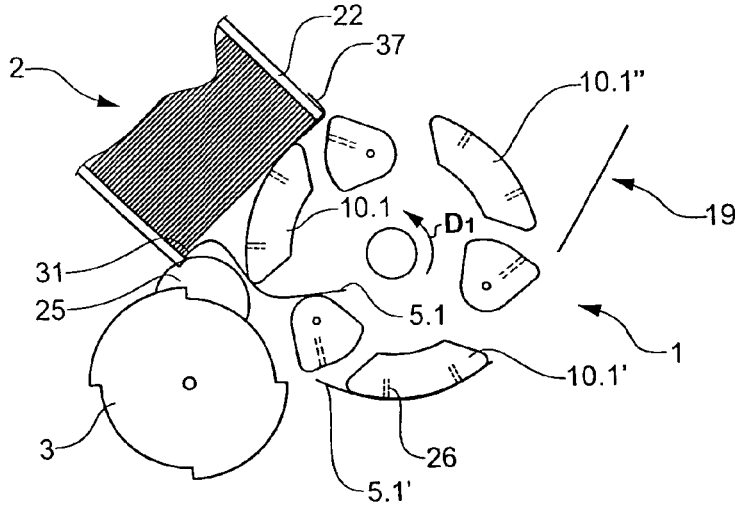

The flipping-over of the product 5.1 is initiated in the course of the further rotation of the separation device 1 into the configuration shown in FIGS. 2*d* and 2*f*, wherein, in each case, a further rotation of the device by 20 in the direction of rotation D1 is shown. In the position shown in FIG. 2*d*, the conveyor element 10.1 is introduced between the lowermost product 5.1 which continues to be supported on the stabilized edge 31 and at the same time supports the stack 2 at its free edges in the region of the guide surface 22. During the rotational movement of the device in the direction of rotation D1, the outer surface 16.1 of the conveyor element 10.1 rolls on the lower side of the second lowest product 5.2 and at the same time penetrates further and further between the two products 5.1 and 5.2. Due to the continuous rotation and the geometry of the initiation element 11, no collision between the initiation element 11 and the conveyor element 10 occurs (that is, among other elements in the movement paths shown in FIGS. 2*d* and 2*e*). Due to the expulsion of air at the openings 26 of the conveyor element 10, undesired frictional forces between the stack 2 and the conveyor element can be avoided and an optimized function can be achieved even with high processing speeds. At the same time, the lowermost product 5.1 is forced away firstly downwards and then increasingly in the direction of the stabilized edge 31 by the short surface 17.1 and/or the leading surface 18*a* of the conveyor element 10.1 and, in the position shown in FIG. 2*e*, the edge or the end 34*a* and/or the long outer-lying surface 16.1. During the movement path of the conveyor element 10.1 shown in FIGS. 2*e* to 2*f*, the lowermost product 5.1 is first bent slightly downward but then increasingly in a bulging-out manner until in FIG. 2*f* an S-shaped deformation of the product 5.1 is present. This deformation results from the movement direction of the conveyor element 10 in the direction of the free edge 32 to the stabilized edge 31. In this embodiment, the kinematics and the geometry of the elements 10 and 11 permit and support the release of the products (only a slightly arcuately bent alignment of the product between the elements 10 and 11 in the direction of the axis as shown in FIG. 2*e*). The conveyor element 10 shown in FIGS. 2*c* to 2*f* carries out a double function. On the one hand the conveyor element 10 effects the (temporary) stabilization of the stack in the region of its free edges (dynamic support of the second lowest product), and, on the other hand, the flipping-over of the frontmost product 5.1 is effected. Furthermore, the suction element (openings 26) which are arranged on the outer edge 16.1 in this phase suction no air (in contrast, they preferably expel air), since otherwise it would not be the lowermost but the second lowest product which would be seized. In other words, the conveyor element executes several functions, partly simultaneously, partly sequentially after one another, wherein, with this embodiment, these functions in a first phase are sequentially: (a) dynamic support of the stack (see FIG. 2*c*); (*b*) dynamic support of the stack and lifting of the lowermost product (see FIG. 2*d*); and (*c*) dynamic support of the stack and the continuous flipping-over of the product (see FIGS. 2*e* and 2*f*).

The product 5.1 shown in FIG. 2*f* has not yet been completely separated, but, even though it has been lifted to a great extent, still belongs to the supply stack and is supported at its stabilized edge 31 by the stabilizer 25. In order to explain the second phase of the separation, one refers back to FIG. 2*a*. Here the lowermost product, from now provided with the reference numeral 5.1', can be recognized in its next position. Now the side of the product which lies upwards in the stack position rests on the outer surface 16.1' of the conveyor element 10.1 over a first (comparatively small) region 33.1.

In this region 33.1 the product is now seized by the suction element (see element 26 in FIG. 2*d* to 2*f* and the discussion of FIG. 3 below) and other holding members. During the continued rotation into the position shown in FIG. 2*b*, the product 5.1' is continuously applied to the outer surface 16.1' and is additionally held with a non-positive fit by suction element 26.

As shown in FIG. 2*b*, with a further rotation of the separation device 1 in the direction of rotation D1, the rotation body (auxiliary element 3) is synchronized such that its first press surface 8.1 bears on the conveyor element 10.1 and a clamping gap is formed between these two parts, which forms a conveyor element for the product 5.1' lying therebetween. In place of a rotating body, another auxiliary element can be provided to support the separation in the last phase.

By this arrangement, the product 5.1' is siezed with an adequate force from the position shown in FIGS. 2*b* and 2*c*, in order to effect the complete removal from the stack and, where appropriate, the release of the adhesive connection to the subsequent product 5.1, since the forces acting on the product 5.1' in this phase are essentially transverse to the suction element 26. This force effect can otherwise lead to an undesired relative movement between the product 5.1' and the conveyor element 10.1'. In this phase of the complete release of the product 5.1' from the stack or from the subsequent product 5.1, the release force is supported by the quasi-static stabilizer 25 which is formed by a freely rotatable roller which minimizes the friction forces occurring at the stabilized edge 31. Furthermore, by this roller, as a result of its suitably selected diameter, the product can be guided in a gentle manner and the force vector on release can be influenced in a favorable manner.

With this second phase of the separation, an optimal force diagram with respect to the peeling-away in the region of the stabilized edge 31 is achieved. By the bending effect in the region of the stabilized edge 31 (see FIGS. 2*a* to 2*c*), a continuous release of the product is effected with a force in the direction of the arrow F1, so that any adhesive regions present can be detached in a gentle manner without an unfavorable shearing occurring transversely to the arrow direction F1. In this manner, products having an adhesive element, in particular adhesive notebook sheets, for example, can be separated and detached from one another in a gentle manner even at high processing speeds.

In the end phase of the separation, an optimal release with a force vector in the direction of the arrow F1 is achieved and at the very end supported by a rotation and guided by the roller 25. After the complete release of the edge 31' (FIG. 2*c*) of the product 5.1, it is conveyed yet further through the clamping gap 28 and is applied to the outer surface 16.1' or is seized by the suction element 26, in an optimal manner.

With the further conveying (FIGS. 2*d* and 2*e*), the product 5.1' is then completely conveyed out of the clamping gap 28 and finally only continues to be seized by the conveyor element 10.1' or by its suction element 26 and at a transfer location 19 can be transferred to a further conveyor element (see FIG. 1) or directly onto a printed product or another object. The release is effected preferably by a control of the suction element 26 or by a suitable take-over element, such as by suction elements of a take-over device 20 (FIG. 1) which have a greater force effect. The suction element 26 shown here can also be formed by other members which create a non-positive fit with the products 5 to be conveyed, for example, by elements which exploit an electrostatic adhesion.

Figure 3:
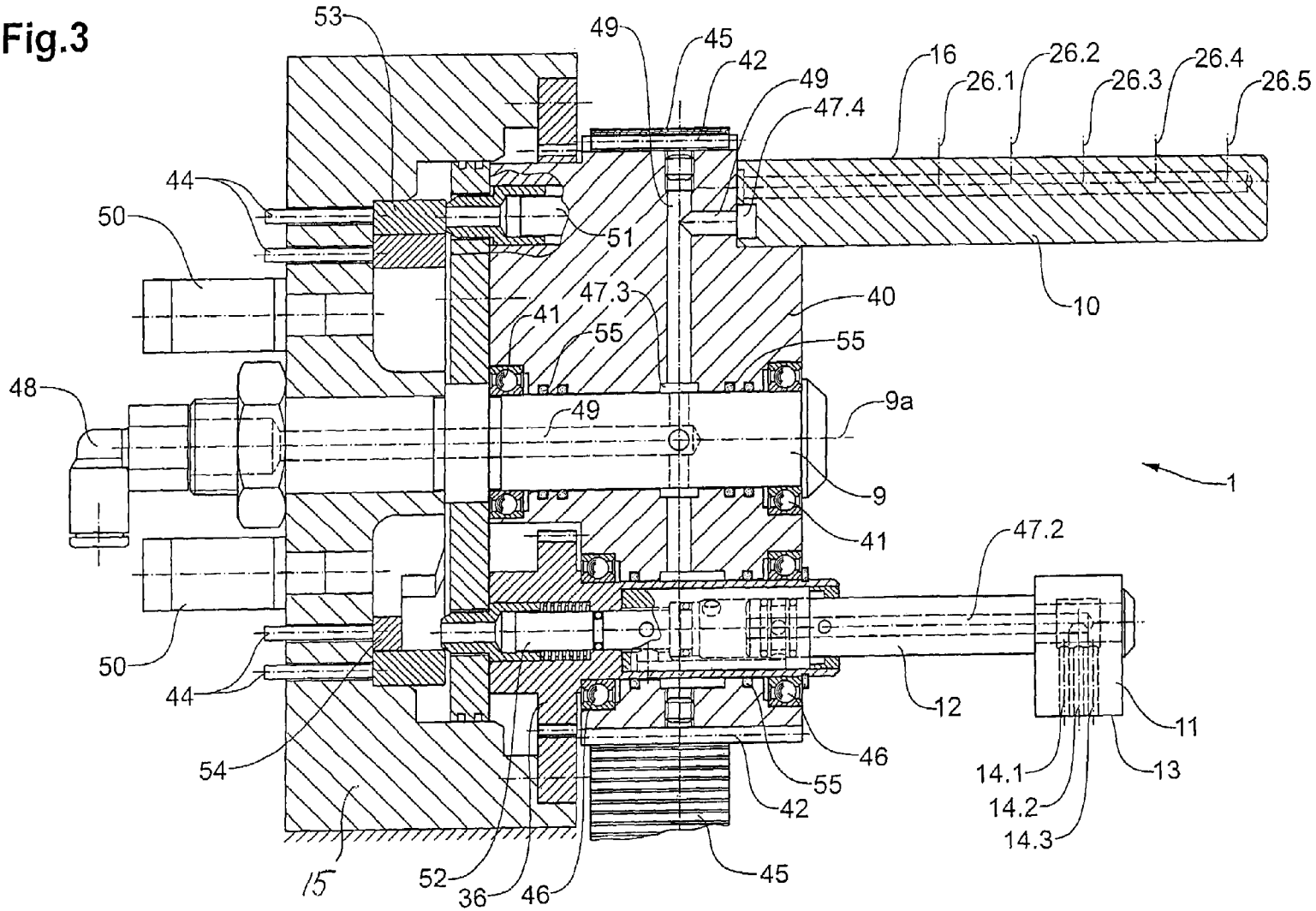
FIG. 3 is a view of a section through a separation device according to an embodiment of the present invention, along a plane through the main rotation axis.
Figure 4:
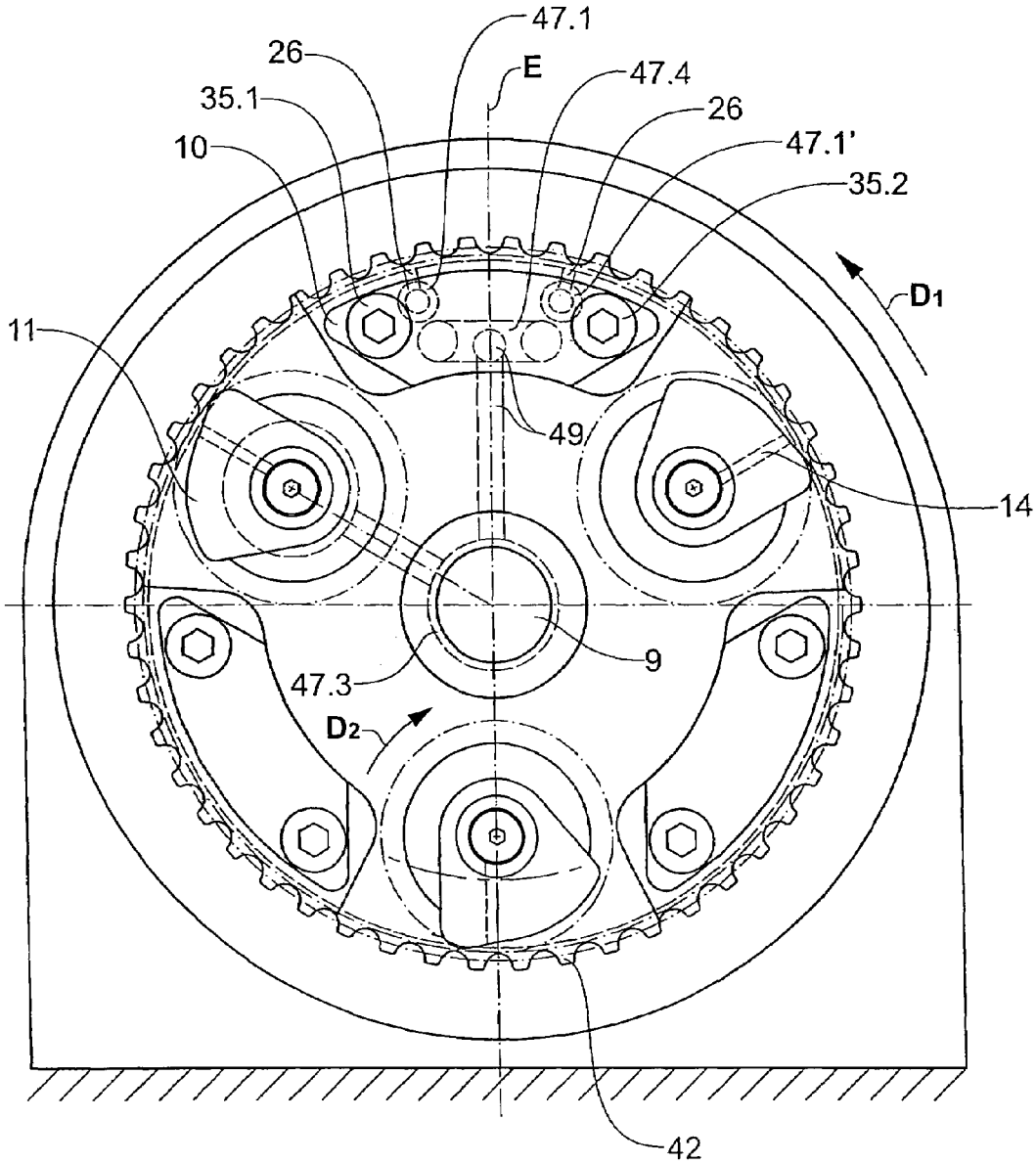
FIG. 4 is a view of the separation device according to an embodiment of the present invention.

The construction of the separation device 1 and the desired control of the seizing of the product is explained in more detail by the FIGS. 3 and 4. FIG. 3 is a view of a section through the separation device 1 along a plane E (see FIG. 4) which runs through the main rotational axis 9. A cylindrical base element 40 is rotatable about a geometrical axis 9*a* on the main rotation axis 9 by ball bearings 41. FIG. 4 is a front elevation of the separation device 1. Corresponding components are characterized by the same reference numerals.

The section represented in FIG. 3 shows a conveyor element 10 which is rigidly connected to the base element 40 by screws 35.1 and 35.2 (see FIG. 4). The base element 40 includes teeth 42 on its periphery. A toothed belt 45 which is driven by a conventional drive (not shown) meshes with the teeth 42 and effects the rotation of the separation device in the counterclockwise direction (see direction of rotation D1 in FIG. 1). An initiation element 11 is arranged on a rotation axis 12. This rotation axis 12 is rotatably mounted in the base element by ball bearings 46. The drive of the rotation axis 12 is effected via a pinion 36 which meshes with inner teeth of the stationary housing 15. With other embodiments, a gearing up/down for this drive or a control of the rotational speed which is dependent on location can also be provided.

The suctioning and release of the products by the conveyor element 10, and the lifting of the products by the initiation element 11 are effected by a pressurized-air operated pneumatic system. Pressurized air is supplied centrally to the pneumatic system via a pressurized air connection element 48. Several bores 49 serve as distribution channels of the pressurized air up to the conveyor elements 10 and the initiation element 11. Air distribution chambers are provided at locations where the air is to flow into rotating components. Such an air distribution chamber 47.3 is, for example, provided in the region of the main rotation axis 9. The remaining air, inasmuch as no discharge is effected at the elements 10 and 11, is led away via the bleed ports 50. The individual components of the separation device 1, where necessary, are mutually sealed in an airtight manner by seals 55 of which only a few are provided with a reference numeral by example, so that the required pressure relief in the pneumatic system can be effected.

The system has pressure constantly applied via the pressurized air connection elements (unions) 48. This air flows via distribution channels, adjustable where appropriate by a settable throttle (not shown), to the openings 26.1 to 26.5 on the outer surface 16 of the conveyor element 10 or to the openings 14.1 to 14.3 on the outer-lying surface 13 of the initiation element 11. On starting the system, a continuous build-up of pressure in the system is effected and pressurized air exits at the openings 26 and 14. The distribution channels for the conveyor element 10 include a first injector distributor 51, and the distribution channels for the initiation element 11 include a second injector distributor 52. These injector distributors 51 and 52 are each controlled by radial cams 53 and 54 which are stationary, such that air is led to the respective distribution chambers 47.1 and 47.2 of the conveyor elements 10 and the initiation elements 11, and expelled via the openings 14 and 26. In dependence on the respective cam 53 and 54, in other regions (or at certain time intervals) the flow of air is diverted such that a vacuum in the distribution chambers 47.1 and 47.2 arises and suctioning at the openings 26 and 14 is effected. The radial cams 53 and 54 can be set by adjusting elements 44. The injector distributors 51 and 52 are controlled to effect a discharge of air ("repulsion of the product") at the openings 14 and 26 during certain time intervals and/or in regions, and a suctioning of the air ("seizing of the products") at other time intervals or in other regions. The distribution of air in the pneumatic system can thus be controlled in a precise manner.

When required, the individual distribution chambers 47.1 and 47.1' (FIG. 4), of which only one is shown in the sectioned representation of FIG. 3, can be sequentially controlled for the openings 26. With this, a share of the openings 26 on the outer surface 16 of the conveyor element 10 can suction air and thus seize a product, while air is expelled at other openings 26 and thus the product is released in a controlled manner. With reference to the rotational positions shown in FIGS. 2*a* to 2*f*, this corresponds to the following: (a) discharge of air via the openings of the conveyor element 10.1 (FIGS. 2*a* to 2*f*); (b) suctioning of air at the leading openings and expulsion of air at the trailing openings of the conveyor element 10.1' (FIG. 2*a*); (c) suctioning of air at all openings of the conveyor element 10.1' (FIGS. 2*b* to 2*f*); (d) discharge of air at the forward openings and suctioning of air at the trailing openings of the conveyor element 10.1" (FIG. 2*c*); (e) ejection of air at all of the openings of the conveyor element 10.1" (FIGS. 2*d* to 2*f*).

In an analogous manner, the supply of air in the initiation elements can be controlled with respect to time or in a manner dependent on location.

With special applications, the two-dimensional (sheet-like) products can also have a geometry which differs from a rectangular shape. The present invention also permits the separation to be effected with such products. The stabilization is then no longer effected necessarily at an "edge" but can be accomplished via suitable stabilizer 25 such that only a pointwise stabilization at the accessible regions is effected, for example, by one or more freely rotating balls. The guide surfaces 21 and 22 in this case can be replaced in a suitable manner by rods or other guide profiles. Where appropriate, the guide surfaces can also have movable elements which reduce the friction forces.

With a particularly exemplary embodiment, a guide element 37 (represented schematically in FIGS. 2*a* to 2*c* and 2*f*) is arranged in the vicinity of the free edges of the products 5 in the stack 2. This, even with high processing speeds and/or with possible deformation of the free edges 32 of the products 5, serves to ensure that the conveyor elements 10 are introduced exactly between the lowermost and the second to bottom products 5.1 and 5.2 and do not also seize or damage the subsequent product (schematically represented positions of the guide element 37 in FIGS. 2*a* to 2*c* and 2*f*). With this, the initiation elements 111 on their approach to the stack support this in the correct position, wherein the guide element does not obstruct this (FIGS. 2*a* and 2*b*). The geometries of the elements 10 and 11 (essentially circular segment shaped geometry or kidney-shaped) permit the targeted movement of the guide element and simultaneously describe the necessary movement curves. The guide element 37 can be designed as a controlled finger or as a deformable plastic plate which passively undergoes an elastic deformation with the passage of the conveyor elements 10, and thus holds back the second lowest product until the respective element 10 or 11 has effected the dynamic support or stabilization at the correct location.

With a different embodiment, which is not shown here, the initiation element can also be designed as a stationary, controlled element which does not co-rotate with the conveyor elements 10. A further design alternative envisages arranging the initiation element 111 directly on the conveyor elements 10. In this case, pivotable support members are provided on the leading end 34*a* (FIG. 2*d*) of the conveyor element 10, the members running below the supply stack and lifting-off the lowermost product. As soon as the conveyor element can carry out its dynamic stabilization, the support member is pivoted back or into the conveyor element.

Particularly with large products, it is furthermore possible to let the rotating path of the periphery of the conveyor elements 10 and the initiation elements 11 to run along a curve which is different from a circular path, for example, by elements running in guide rails. With such an embodiment too, the conveyor element 10 includes a flattened geometry and is arranged on the separation device 1 such that a product 5 to be seized is moved by a leading side 18*a* or edge 34*a* (see FIG. 2*c*) of the conveyor element 10 in the direction towards the stabilized edge 31 of the product 5 and, as described hereinafter in more detail, is separated. Furthermore, the conveyor element 10 can also comprise several parts, and, for example, can be formed of two separate parts which are situated directly behind one another.

The present invention also permits the arrangement of the supply stack basically in an infinite spatial position, in particular, above the separation device, and despite this allows it to carry out an exact separation of the products which takes place at a high processing speed. With a variant of the method according to the present invention, in each case, on replenishing the supply stack 2 with additional products, the respective frontmost product is coated with an (additional) adhesive, so that the last product of the remaining stack and the first product of the refilling stack stick to one another. By this, undesirable disturbing influences as a result of differences in friction or adhesion between the products of the various stacks can be avoided.

Figure 5:
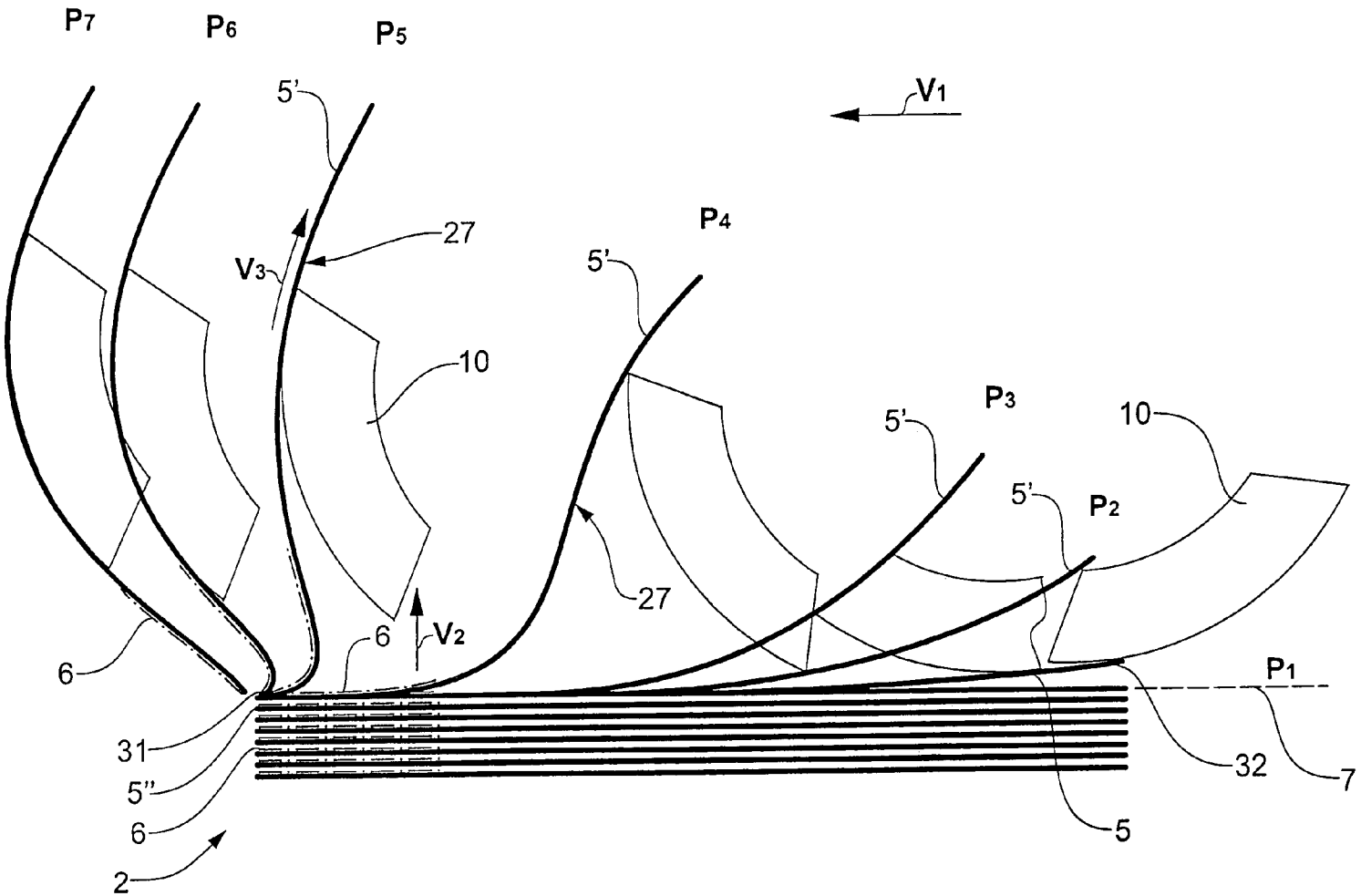
FIG. 5 is a schematic representation of the lifting-off and separation process of a printed sheet.

The separation of products coated with an adhesive is shown in FIG. 5. The conveyor element 10 is only shown in a schematic manner and is not moved on a circular path but rather on an elliptical path and, during movement in this path, is pivoted analogously to the above description. Its functional side surfaces or edges can come into functional interaction with the product at the desired moment.

A stack 2 of products 5 coated with adhesive on one side is arranged in a lying manner. The adhesive 6 is deposited on the upper side of the products 5 and is indicated by a dot-dash line. The adhesive has the property that the individual products, for example, sticking (adhesive) notes, are released from one another without adhesive residues becoming visible. The adhesive are in turn released from the envisaged articles on which the product is attached, or can have a permanent bonding. The products are stabilized on the side coated with adhesive by a stabilizer 25 (see FIG. 1).

At a position P1, the free edge 32 of a first product 5 is slightly lifted. At this moment, the conveyor element is not yet in functional interaction with this product or the stack 2. In a next position P2, a conveyor element 10 runs below the product 5' and displaces it in the movement direction V1. By this displacement in the direction of the free edge 32 to the stabilized edge 31, the product is lifted from the stack and, in the position P3, is supported by the conveyor element 10. The product still lies flat at the stabilized edge 31, i.e. the adhesive of the subsequent product does not completely fix the product 5' to be lifted. The dynamic stabilization of the stack 2 which with this embodiment is arranged in a lying manner is only significant to the extent that a counter force is required on this stack for lifting the frontmost (that is, the uppermost) product.

At the position P4, the product 5' has already been lifted and the actual flipping-over of the product is initiated. The adhesive-coated part of the following product 5" is loaded by a force perpendicular to the product stack in the direction of the arrow V2 and a release from a part of the adhesive layer begins. At the same time, the product 5' to be lifted away continues to be moved in the direction of the arrow V1, that is, parallel to the stack plane 7. By this movement, the adhesive is not sheared away parallel to the plane 7 of the stack, but rather the product 5' is continuously released from small-area part regions of the adhesive of the following product 5". The product only undergoes a movement component in the longitudinal direction V3 of the product (essentially perpendicular to the stack plane 7) in the last phase of the separation, approximately at position P5.

In the following position P5, the product 5' is substantially released from the following product 5" and continues to be held only at its outermost edge by the stabilizer 25 (not shown here) and the remaining region of the adhesive. In this position, the product has assumed an S-shape which permits the conveyor element 10 to seize the product 5' at its originally distant lower side 27 by the retaining element.

The product 5' is held with a non-positive fit, and pushed back further in the direction V1 and reaches the position P6 before its definitive release from the stack, The product 5' is seized by the conveyor element 10 over a large area and, at position P7, is released from the stack 2. The whole lifting and release process is effected by the conveyor element 10 which moves in the direction V1, wherein only in the last phase from position P5 is the conveyor element supported by an additional auxiliary element, preferably a rotating body 3 (see FIG. 1), for overcoming the release and separation forces. The product 5' is not only pushed back by the conveyor element 10, but the conveyor element runs beneath the product (P2, after lifting by the initiation element), the product 5' is seized at its originally distant side surface 27 (P4 to P7), is finally flipped over (approx. P5 to P6) and is conveyed further (P7) by the same element 10. Due to this multi-functionality of the conveyor element, not only can a precise separation be effected at a high speed, but also simultaneously at a comparatively low cost. As shown in FIG. 5, in the last phase of the separation (P6/P7), the product is moved in the direction V1 and only the adhesive-coated region has an actual movement component in the direction V2. The separation of adhesive-coated products is effected without the adhesive-coated region coming into contact with the separation element. The adhesive-coated region is not compromised during the further transport.

Inasmuch as the products lie in the supply stack such that their adhesive side is attached on the distant side 27 of the product, a take-over device 20 (see FIG. 1) is preferably arranged downstream of the separation device 1, the take-over device applying the adhesive-coated products onto the envisaged articles (in FIG. 1 indicated schematically at 56), printed products or other objects, assuming a turn-over effect for these. At the same time, the products 5 are initially only stabilized at one edge or on a part region, and are free at the remaining regions, i.e. can be lifted from the stack in these free regions.

What is claimed is:

1. A method of separating and transporting flexible, two-dimensional products, the method comprising:

providing a product supply stack including a separation device and at least one conveyor element to separate products stabilized only at a portion thereof and to convey the products to a transfer location;

wherein the conveyor element has a direction of movement parallel to a plane of the product supply stack and moves in a direction from a free region of the products to a stabilized region of the products;

wherein the conveyor element moves beneath a frontmost product of the product supply stack and subsequently seizes the frontmost product with a non-positive fit on a distant side of the frontmost product;

wherein the products are moved such that portions of the products at a stabilized edge experience a force effect perpendicular to the product supply stack plane and experience a movement component in the longitudinal direction of the products only in the last phase of the separation of the products; and wherein the products at their stabilized regions are supported by a stabilizer having moving parts to reduce friction forces in the last phase of the separation of the products.

2. The method according to one of the claim 1, wherein the products are lifted by an initiation element moving in the same direction as the conveyor element and beneath by the conveyor element.

3. The method according to claim 1, wherein an initiation element and a conveyor element dynamically alternately support the supply stack.

4. The method according to claim 1, wherein the conveyor element in the last phase of the separation of the products cooperates with an auxiliary element to overcome the release force.

5. The method according to claim 1, wherein the products are transferred to a take-over device arranged downstream of the separation device, the separation device turning the products and applying the products onto designated articles.

6. The method according to claim 2, wherein air is selectively expelled or suctioned via openings in the conveyor elements and initiation elements by a pneumatic system, wherein air is discharged at a portion of the openings of at least one of the conveyor elements and initiation elements, and air is suctioned at another portion of the openings of the same conveyor and initiation elements.

7. The method according to claim 6, wherein the air distribution in the pneumatic system is controlled by cams and wherein air is discharged or suctioned via the openings in the conveyor elements and initiation elements at least one of temporarily and regionally.

8. An apparatus to separate and transport flexible, two-dimensional products, the apparatus comprising:

a product supply stack including a separation device and at least one conveyor element arranged to separate products stabilized only at a portion thereof and to convey these to a transfer location;

wherein the at least one conveyor element rotates along an endless path and has a flattened geometry and is arranged on the separation device such that a product to be seized is moved by a leading side or edge of the at least one conveyor element in a direction towards a stabilized edge of the product and is flipped over and is seized by the conveyor element and further transported;

wherein the products are moved such that portions of the products at a stabilized edge experience a force effect perpendicular to the product supply stack plane and experience a movement component in the longitudinal direction of the products only in the last phase of the separation of the produts; and wherein the at least one conveyor element comprises a flattened, kidney-shaped geometry, continuously rotating about a main rotation axis, and on a radially outwardly-lying longer side surface comprises several members creating a non-positive fit with the products to be conveyed.

9. The apparatus according to claim 8, further comprising an initiation element arranged in front of the at least one conveyor element, wherein the initiation element is also moved along the movement path of the conveyor element and is arranged to initially lift a product from the product supply stack.

10. An apparatus to separate and transport flexible, two-dimensional products, the apparatus comprising:

a product supply stack including a separation device and at least one conveyor element arranged to separate products stabilized only at a portion thereof and to convey these to a transfer location;

wherein the at least one conveyor element rotates along an endless path and has a flattened geometry and is arranged on the separation device such that a product to be seized is moved by a leading side or edge of the at least one conveyor element in a direction towards a stabilized edge of the product and is flipped over and is seized by the conveyor element and further transported; and wherein the products are moved such that portions of the products at a stabilized edge experience a force effect perpendicular to the product supply stack plane and experience a movement component in the longitudinal direction of the products only in the last phase of the separation of the products;

the apparatus, further comprising an initiation element arranged in front of the at least one conveyor element, wherein the initiation element is also moved alone the movement path of the conveyor element and is arranged to initially lift a product from the product supply stack;

wherein the initiation element is driven about an axis in opposite directions to the rotational direction of the at least one conveyor element.

11. The apparatus according to claim 8, further comprising an auxiliary element arranged to support the separation by the at least one conveyor element, the auxiliary element being arranged in the region of the stabilized edge of a frontmost product of the product supply stack.

12. An apparatus to separate and transport flexible, two-dimensional products, the apparatus comprising:

a product supply stack including a separation device and at least one conveyor element arranged to separate products stabilized only at a portion thereof and to convey these to a transfer location;

wherein the at least one conveyor element rotates along an endless path and has a flattened geometry and is arranged on the separation device such that a product to be seized is moved by a leading side or edge of the at least one conveyor element in a direction towards a stabilized edge of the product and is flipped over and is seized by the conveyor element and further transported; and wherein the products are moved such that portions of the products at a stabilized edge experience a force effect perpendicular to the product supply stack plane and experience a movement component in the longitudinal direction of the products only in the last phase of the separation of the products;

the apparatus, further comprising an initiation element arranged in front of the at least one conveyor element, wherein the initiation element is also moved along the movement path of the conveyor element and is arranged to initially lift a product from the product supply stack;

wherein the initiation element comprises a circular segment shaped geometry.

13. An apparatus to separate and transport flexible, two-dimensional products, the apparatus comprising:

a product supply stack including a separation device and at least one conveyor element arranged to separate products stabilized only at a portion thereof and to convey these to a transfer location;

wherein the at least one conveyor element rotates along an endless oath and has a flattened geometry and is arranged on the separation device such that a product to be seized is moved by a leading side or edge of the at least one conveyor element in a direction towards a stabilized edge of the product and is flipped over and is seized by the conveyor element and further transported; and wherein the products are moved such that portions of the products at a stabilized edge experience a force effect perpendicular to the product supply stack plane and experience a movement component in the longitudinal direction of the products only in the last phase of the separation of the products;

the apparatus, further comprising an initiation element arranged in front of the at least one conveyor element, wherein the initiation element is also moved along the movement path of the conveyor element and is arranged to initially lift a product from the product supply stack;

wherein the separation device comprises a pneumatic system connected to openings on the at least one conveyor element and on the initiation elements such that air is selectively discharged or suctioned at these openings.

14. The apparatus according to claim 8, further comprising a guide element arranged in a region of the free edge of the product to be separated, the guide element supporting the respective subsequent product to be separated.

15. The apparatus according to claim 13, wherein the pneumatic system comprises injector distributors controlled by cams to discharge or suction air via the openings at least one of temporarily and regionally.

* * * * *